US006443376B1

(12) United States Patent
Huang et al.

(10) Patent No.: US 6,443,376 B1
(45) Date of Patent: Sep. 3, 2002

(54) APPARATUS FOR PULVERIZING AND DRYING PARTICULATE MATTER

(75) Inventors: Ching-Chung Huang, Summit; Qingsheng Lin, Marray Hill; Robin T. Voorhees, Basking Ridge, all of NJ (US)

(73) Assignee: Hosokawa Micron Powder Systems, Summit, NJ (US)

( * ) Notice: Subject to any disclaimer, the term of this patent is extended or adjusted under 35 U.S.C. 154(b) by 0 days.

(21) Appl. No.: 09/464,205

(22) Filed: Dec. 15, 1999

(51) Int. Cl.[7] ..... B02C 19/06

(52) U.S. Cl. ..... 241/52; 241/56; 241/61; 241/80; 241/82

(58) Field of Search ..... 241/56, 80, 82, 241/52, 61

(56) References Cited

U.S. PATENT DOCUMENTS

| | | | | | |
|---|---|---|---|---|---|
| 2,754,967 | A | * | 7/1956 | Lykken | 209/144 |
| 3,071,330 | A | | 1/1963 | Jackering | 241/53 |
| 3,610,542 | A | | 10/1971 | Yamagishi | 241/43 |
| 3,987,970 | A | * | 10/1976 | Burkett | 241/43 |
| 4,189,102 | A | * | 2/1980 | Andrews | 241/5 |
| 4,562,972 | A | | 1/1986 | Hagiwara et al. | 241/260 |
| 4,690,338 | A | * | 9/1987 | Sayler et al. | 241/56 |
| 4,930,707 | A | * | 6/1990 | Oshiro et al. | 241/5 |
| 5,330,112 | A | * | 7/1994 | Nagaoka et al. | 241/57 |
| 5,419,499 | A | * | 5/1995 | Bourne | 241/18 |
| 5,577,670 | A | * | 11/1996 | Omata et al. | 241/5 |
| 5,695,130 | A | * | 12/1997 | Csendes | 241/19 |
| 5,732,894 | A | * | 3/1998 | Sheahan | 241/56 |
| 5,865,381 | A | * | 2/1999 | Mitsumura et al. | 241/18 |

FOREIGN PATENT DOCUMENTS

EP 0 775 526 A1 5/1997

OTHER PUBLICATIONS

Hosokawa Micron Powder Systems, "The Mikro Long Gap Mill, Ultra–fine Grinding *Impact Flash Drying *Particle Coating", brochure, 1 page (undated).
Altenburger Maschinen, "Ultra Rotor", brochure, 2 pages (undated).
C–E Bauer Combustion Engineering, Inc., "Hurricane Pulverizer Classifier", brochure, 4 pages (undated).
Atritor Limited, brochure, 2 pages (undated).
International Process Equipment Company, brochure, 3 pages (undated).
Bauermeister, Inc., "ASIMA Mill", brochure, 3 pages (undated).
Hosokawa Micron Powder Systems; "The Mikro Long Gap Mill, Ultra–fine Griding *Impact Flash Drying *Particle Coating".
Naoto Tonoike et al.; Nisshin Flour Milling Co., Ltd.; "Fine Pulverizing of Heat Sensitive Plastics Using Mechanical Mills"; pp. 363–369.

* cited by examiner

*Primary Examiner*—Allen Ostrager
*Assistant Examiner*—William Hong
(74) *Attorney, Agent, or Firm*—Winston & Strawn

(57) ABSTRACT

The invention relates a pulverizer equipped with a free air purging mechanical seal/classifier design that provides free air purging of the seal gap between the mechanical seal assembly and the classifier. The invention also provides a coarse particle extraction assembly wherein the coarse particles rejected by the classifier can be reliably discharged from the pulverizer or recirculated to the inlet. Furthermore, the rejected coarse particles can be subjected to jet milling and then recirculated. The invention also provides a free air cooling arrangement for cooling both the lower bearing member and the area of the vertical drive shaft where it meets the lower bearing member. The invention also provides an improved feed nozzle for use of the pulverizer in drying applications.

23 Claims, 6 Drawing Sheets

(CONVENTIONAL PULVERIZER)

APPARATUS FOR PULVERIZING AND DRYING PARTICULATE MATTER

TECHNICAL FIELD

This invention relates generally to improvements in pulverizers, including the separation of coarse particles from fine particles, an improved free air purging mechanical seal assembly provided between the classifier and housing, free air cooling of the drive shaft, and a feed distributer which facilitates the drying of wet particulate material.

BACKGROUND

Pulverizing of dry materials is practiced today using hammer mills, impact attrition mills, ball mills, and others outfitted with internal classifiers that separate the coarse and the fine particle fractions. Problems with these mills include inadequate internal circulation of material flow thereby causing excessive grinding, reduced classifier efficiency, lower throughput, and wearing of certain parts of the mill.

A typical impact attrition pulverizer, shown in FIG. 1, comprises vertically oriented cylindrical housing 2 provided with air inlet 3, feed inlet 4, and product outlet 6—coordinated with a suction device (not shown), coarse particle exit tube 8, and classifier 10. Conventional classifiers typically comprise a vaned wheel that generates a centrifugal air flow. A problem with the type of classifier shown in FIG. 1 is inefficient particle separation. More sophisticated classifiers capable of higher particle separation efficiency have been developed, but with these, particle buildup between the classifier and the housing necessitates frequent disassembly and cleaning and can cause mechanical failure.

Housing 2 has inner liner 28 that is preferably provided with a surface that facilitates pulverization, such as a plurality of ridges that extend parallel to the center line of housing 2. A drive shaft 24 is vertically oriented along the center line of housing 2. Drive shaft 24 coaxially supports rotor 30 and classifier 10. Rotor 30 preferably comprises a plurality of rotor segments 32. A plurality of spaced beater plates 34 reside around the circumference of rotor segments 32, such that the foremost edges of beater plates 34 extend radially toward inner liner 28 and align vertically with drive shaft 24. The rotor segments 32 may be separated from each other by partition disks 36. A particle pulverizing domain 38 is defined between beater plates 34, inner liner 28, as well as in the pocket formed by the beater plates and the partition disks.

During operation, a rotating device (not shown) rotates drive shaft 24 at high speed and the suction device at product outlet 6 pulls external air through the apparatus from air inlet 3 and feed inlet 4. The material to be processed is introduced at feed inlet 4 and is wafted through particle pulverizing domain 38. Within particle pulverizing domain 38, the periphery of rotor 30 (i.e., the edges of beater plates 34) and inner liner 28, cooperate to grind and pulverize the substrate material. The material is ground by impact with beater plates 34 and inner liner 28, as well as attrition between particles.

Classifier 10 allows the finer particles to pass through toward product outlet 6 and the coarse particles are rejected and directed toward the inner liner 28 by the centrifugal force generated by the classifier and thrown out from the coarse particle exit tube 8.

It is undesirable to permit over-sized particles to be discharged with the desired fine particle material at the product outlet. Such particles are regarded as contaminants and lower the quality of the product. It is common practice to remove coarse particles from the classifying zone and recycle them as tailings for further reduction, for example, via the coarse particle exit tube 8 shown in FIG. 1. But this arrangement is insufficient, especially for ultra-fine grinding. In the conventional device described above, removal of the coarse particles relies solely on the momentum of the coarse particle induced by the centrifugal force from the classifier. Thus, the coarse particles, rejected by the classifier, tend to accumulate around the classification zone and eventually leads to clogging and malfunction.

It is especially important to reliably discharge the coarse particle fraction if it includes a contaminant that is harder than the material being ground. It is well known that a small percentage of hard abrasive contaminants can greatly reduce the capacity of the pulverizing apparatus. Such contaminants also make it difficult achieve stringent top-size requirement. For example, limestone, depending on its source, may have a small percentage of alumina or magnesia scale. Since these particles are very hard, they cannot be fully pulverized and they will either continuously re-circulate through the pulverizer or be discharged with the fine particle fraction. Thus, improvements in extraction and grinding of the coarse particles are needed.

It is well known in the art that conventional pulverizers can be used to dry wet particulate matter slurries. In the adaptation of a pulverizer for drying applications, a wet material suspension is dispersed in the pulverization domain and mixed with hot turbulent air. The hot air is introduced into the pulverizer from air inlet 3.

Like other drying processes, under a given capacity, the higher the air temperature, the less air flow required. A problem with adapting conventional pulverizers for drying is overheating of the area where the drive shaft meets the lower bearing member. The overheating is caused by rotational friction and the hot inlet air. Thus, with conventional pulverizers in drying applications, there is a limitation on inlet air temperature and extra oil-cooling arrangements are required to prevent overheating of the area where the drive shaft meets the lower bearing member.

In a drying application, the wet substrate suspension should be introduced directly onto the rotor. This is necessary because a high degree of initial dispersion—provided by the action of the high speed rotor 30—is required for drying. However, the drying efficiency can further be enhanced by a proper design of the feed intake nozzle.

The present invention is directed to an improved device that alleviates these problems and provides features herebefore unknown in the art.

SUMMARY OF THE INVENTION

The invention generally relates to a particle pulverizing apparatus having a cylindrical housing oriented along a vertical axis. This housing is typically provided with an inner liner, an inlet, an outlet, and a rotatable drive shaft oriented along the vertical axis. The drive shaft supports a rotor having an outer diameter such that a particle pulverizing domain exists between the inner liner and the rotor, as well as in the pocket formed by the beater plates and the partition disks.

In one embodiment, a coarse particle extraction assembly is provided. This assembly includes an extraction port in the housing, a pipe positioned adjacent the extraction port and including an air nozzle therein. During operation, the air nozzle discharges an air jet into the pipe to generate a vacuum at the extraction port to extract the coarse particles from the housing through the extraction port. This coarse particle extraction system efficiently removes the coarse particle fraction of the particulate material for collection or further pulverization.

Advantageously, the pipe is configured and dimensioned to provide a non-linear path for the coarse particles, and the air nozzle is positioned such that the air jet can convey and accelerate the coarse particles. Preferably, an impact plate is positioned downstream of the air nozzle for directing the extracted coarse particles back into the housing. If desired, a venturi can be positioned between the air nozzle and the impact plate to guide return of the extracted coarse particles. As used herein, a venturi comprises a tube with a convergent section, a venturi throat, and a divergent section.

In another embodiment, the coarse particle extraction system may include an acceleration chute, positioned between the air nozzle and the impact plate for further accelerating and directing the coarse particles directly onto the impact plate for further grinding. The acceleration chute is a straight tube section extending immediately from a venturi throat.

In another embodiment, the pulverizing apparatus further includes a rotatable classifier positioned on the drive shaft above the rotor and a stationary free air purging mechanical seal assembly supported by the housing and positioned adjacent to the classifier. The classifier advantageously comprises a lip having a plurality of spaced fins thereon and a baffle extending perpendicularly thereto. The free air purging mechanical seal assembly advantageously comprises a stationary casing supported by the housing and having upper, lower, and inner walls defining a annular cavity therebetween. An aperture on the upper wall of the casing opens into a tube, which tube is connected with an air orifice in the housing to allow external air to enter the annular cavity. The lower wall is provided with air path, wherein rotation of the classifier induces air flow by the action of the fins, allowing the air in the annular cavity to pass through the air path over the upper surface of the classifier and into the housing to prevent particles from passing through the seal gap between the baffle and the inner wall.

Preferably, the lower wall includes a groove therein for receiving at least a portion of the classifier lip fins extending vertically.

The air path in the lower wall preferably comprises a plurality of equally spaced holes for controlling the distribution of air onto the upper surface of the classifier.

Preferably, the mechanical seal assembly further comprises an annular opening extending around the inner wall adjacent to the baffle and the lower portion of the inner wall of the casing preferably comprises notch to receive at least a portion of the baffle.

The classifier/free air purging mechanical seal arrangement of the invention prevents mechanical failure and frequent cleaning of the classifier seal required by conventional pulverizers.

In yet another embodiment, the pulverizing apparatus further includes a free air cooling arrangement comprising a stationary sleeve surrounding the drive shaft under the rotor, the stationary sleeve forming a annular duct around the drive shaft for providing a first path for external air to flow through the annular duct into the housing for cooling the drive shaft. Preferably, a rotatable sleeve, rotatably supported by the drive shaft surrounds the stationary sleeve creating an annular void therebetween that provides a second path for the external air to flow into the housing when the apparatus is in operation. This arrangement eliminates the need for extra oil cooling systems.

In still another embodiment, the particle pulverizing apparatus may include a wet material feed intake nozzle, preferably comprising a slot shaped hole located on the housing near the rotor for dispersing a suspension of wet particulate material onto the rotor. Preferably, the slot shaped hole is parallel to the axial direction of the housing.

BRIEF DESCRIPTION OF THE DRAWINGS

These and other features, aspects, and advantages of the invention will become better understood with reference to the following detailed description and appended claims, and accompanying drawings; wherein

DETAILED DESCRIPTION OF THE PREFERRED EMBODIMENTS

Figure 1:
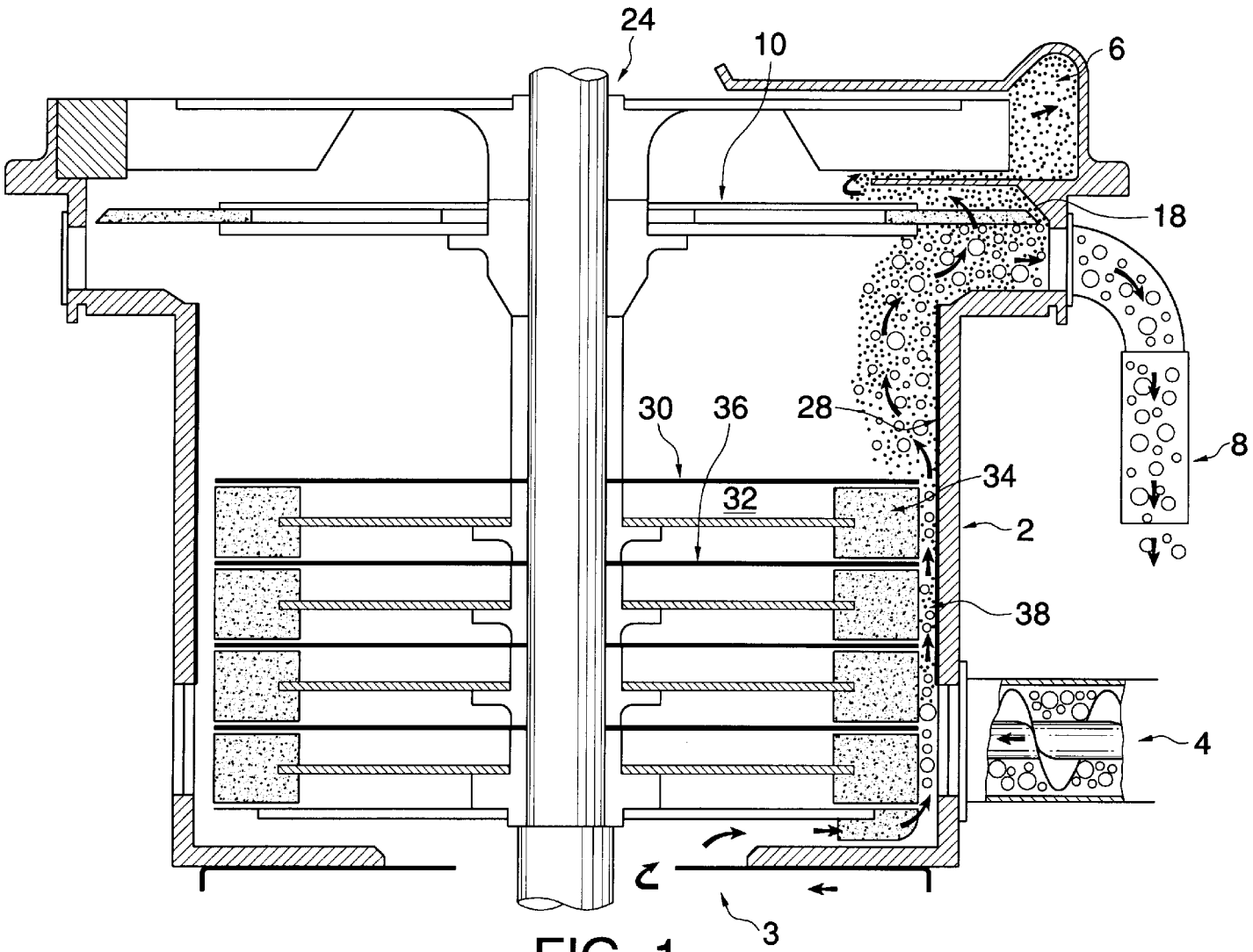
FIG. 1 is a schematic view of a conventional impact pulverizer.
Figure 2:
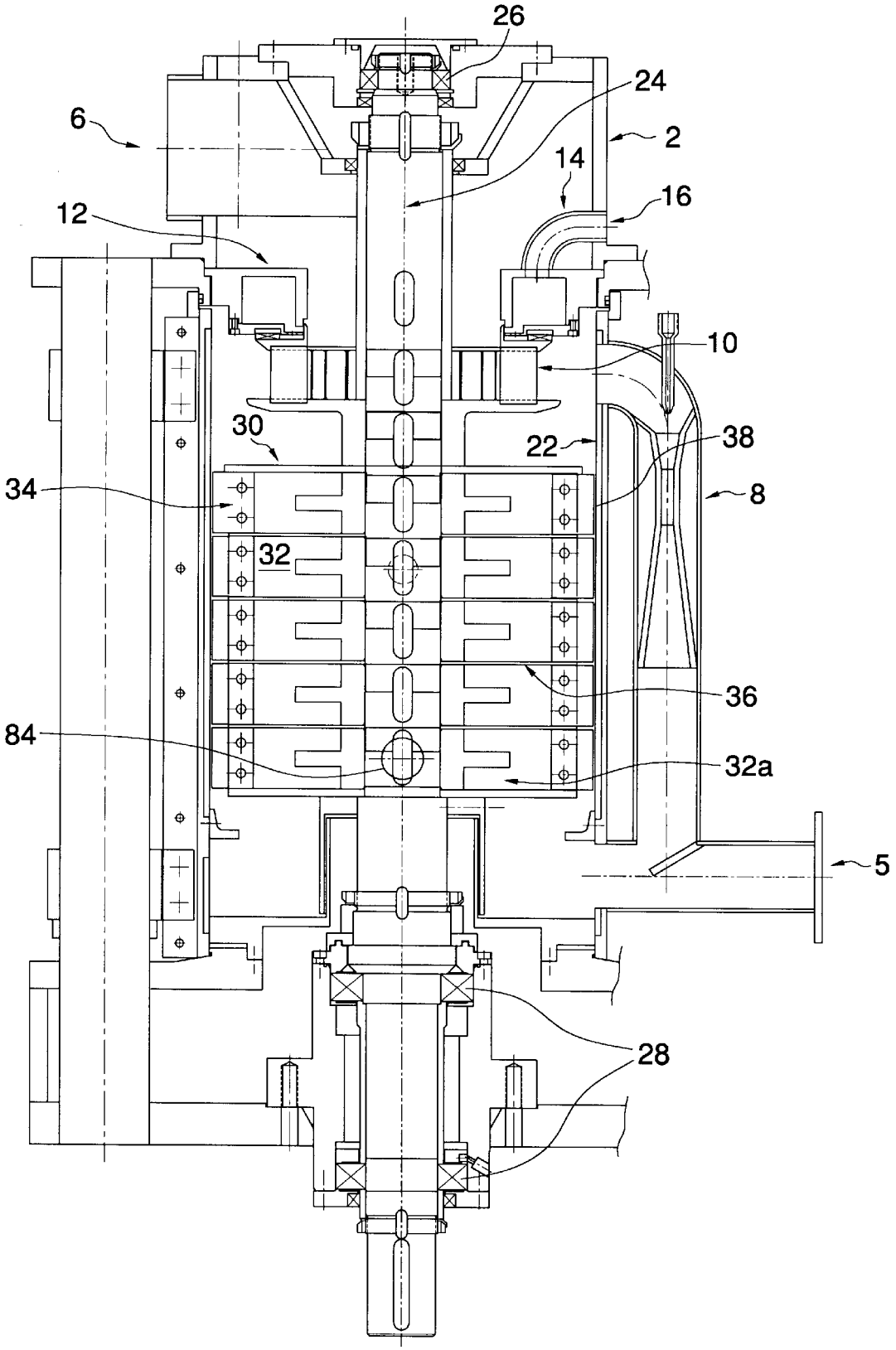
FIG. 2 is a schematic view of a pulverizer according to the present invention.

The pulverizer of the invention is more fully understood with reference to the accompanying drawings. As shown in FIG. 2, the pulverizer of the invention has some features similar to a conventional pulverizer. The preferred pulverizer comprises vertically oriented cylindrical housing 2 provided with inlet 5, outlet 6—coordinated with a suction device (not shown), coarse particle extraction assembly 8, and classifier 10. Over classifier 10, housing 2 supports free air purging mechanical seal assembly 12 connected to air tube 14 that exits housing 2 through air orifice 16.

Housing 2 has inner liner 22 that is preferably provided with a surface that facilitates pulverization, such as a plurality of ridges that extend parallel to the center line of housing 2. A drive shaft 24 is vertically oriented along the center line of housing 2 and is supported by upper and lower bearing members 26 and 28. Preferably, upper bearing member 26 and lower bearing member 28 are located outside of housing 2 and thus are protected from particulate substrate material and the high temperatures in drying applications. Drive shaft 24 coaxially supports rotor 30 and classifier 10. Rotor 30 preferably comprises a plurality of rotor segments 32. A plurality of spaced beater plates 34 reside around the circumference of rotor segments 32, such that the foremost edges of beater plates 34 extend radially toward inner liner 22 and align vertically with drive shaft 24. Preferably, rotor segments 32 are separated from each other by partition disks 36. Preferably, the diameter of partition disks 36 is smaller than the outer periphery of beater plates 34.

A particle pulverizing domain 38 is defined as the gap between beater plates 34 and inner liner 22 and the pockets formed by the beater plates and the partition disks. Preferably, the gap is between about 0.5 mm and about 5 mm. As is well known in the art, variations of the above components or variations in operation parameters allow pulverization of a wide variety of materials in a range of particle sizes. For example, positioning or style of beater plates 34, the ridge pattern of inner liner 22, the dimensions of the pocket formed by the beater plates and the partition disks; the rotor speed; and the air flow rate.

During operation, a rotating device (not shown) rotates drive shaft 24 at high speed and the suction device at outlet 6 pulls external air through the apparatus. The material to be processed is introduced at inlet 5 (by methods well known in the art, e.g., via a screw feeder driven by a variable speed drive) and is sucked into and through particle pulverizing domain 38. Within particle pulverizing domain 38, the periphery of rotor 30 (i.e., the edges of beater plates 34) and inner liner 22, as well as the swirling air flow formed in the pockets, cooperate to grind and pulverize the substrate material. The material is ground by impact with beater plates 34 and inner liner 22, as well as attrition between particles. The rotating device may be any conventional or suitable motor or driving device, all of which are well known to those of ordinary skill in the art.

Classifier 10 allows the finer particles to pass through toward outlet 6 and the coarse particles are rejected. Classifier 10 can be driven by shaft 24 or by an independent drive. Classifiers suitable for use with a pulverizer of the invention are well known in the art, e.g., see U.S. Pat. Nos. 5,419,499 and 2,754,967 both of which are incorporated by reference herein. For use with the present invention, a vane-rotor type air classifier is preferred.

Figure 3:
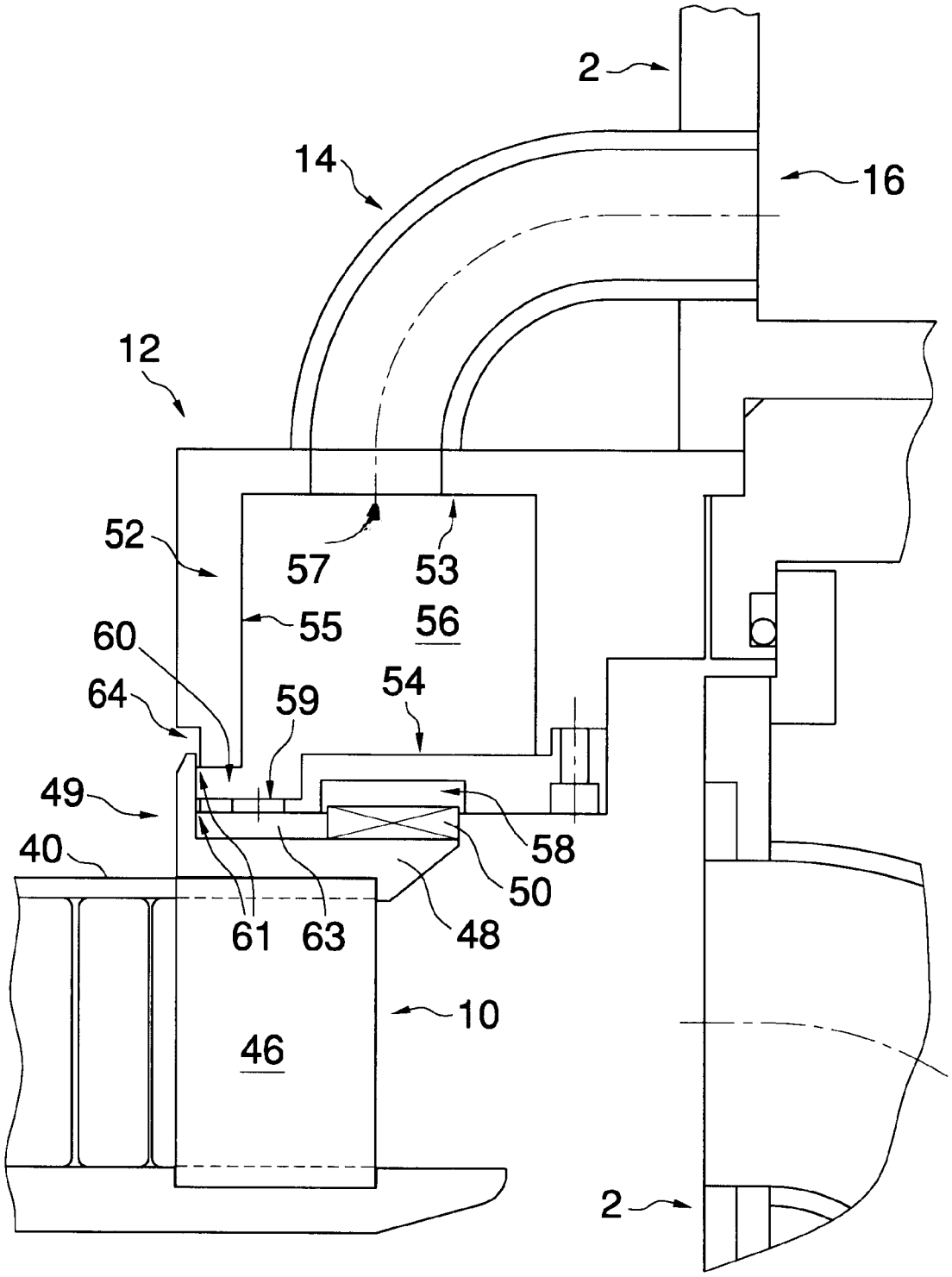
FIG. 3 is a cross sectional expanded view of the classifier and free air purging mechanical seal assembly of the present invention.

FIG. 3 is a detailed view of the classifier with the free air purging mechanical seal arrangement of the invention. Free air purging mechanical seal assembly 12, positioned around the top of classifier 10, prevents particulate matter from entering the upper portion of housing 2 without first passing through classifier 10.

A preferred classifier 10 comprises a classifier wheel 40 having a plurality of spaced vanes 46, baffle 49 extending perpendicularly thereto, and lip 48 which supports a plurality of equally spaced fins 50 of preselected dimension oriented perpendicularly to drive shaft 24.

Free air purging mechanical seal assembly 12 comprises stationary casing 52 supported by housing 2 and having upper 53, lower 54, and inner walls 55 defining annular cavity 56 therebetween. Aperture 57 exists on upper wall 53 and connects annular cavity 56 to tube 14, which tube is connected with air orifice 16. Lower wall 54 includes groove 58 therein for receiving at least a portion of fins 50. Air path 59 extends around the lower wall 54 adjacent to lip 48. Preferably, and an annular opening 60, adjacent to baffle 49, extends around the lower portion of inner wall 55. Small seal gap 61 exists between baffle 49 and the inner side of the lower portion of inner wall 55 and the end of lower wall 54 to allow free rotation of classifier 10. A problem with conventional mechanical seal arrangements has been fouling between the classifier and the mechanical seal. The free air purging mechanism of the present invention prevents such fouling.

Air path 59 can be of any dimension and shape, preferably air path 59 comprises a plurality of equally spaced holes for controlling the distribution of air over the upper surface 63 of classifier 10. Also, preferably, the lower portion of the inner wall 55 of casing 52 comprises notch 64 extending around the lower outside perimeter of inner wall 55 to receive at least a portion of baffle 49.

According to one embodiment of the invention, the special design allows cooperation between free air purging mechanical seal assembly 12 and classifier 10 to keep seal gap 61 therebetween free of particulate matter. As fins 50 rotate, a low intensity suction is generated (opposite to the suction generated by the device at outlet 6) to draw external air through tube 14 into annular cavity 56 through air path 59 to pass over the classifier top 63, and into housing 2. This air flow, in conjunction with suction flow from outlet 6, prevents particles from passing through seal gap 61.

The centrifugal force generated by classifier 10 and the suction generated at outlet 6 act on the mixture of pulverized particles emitted from particle pulverizing domain 38. The finer particles are sucked through classifier 10 into the upper portion of housing 2, from there, to outlet 6, where they are collected. The coarse particles are directed by the centrifugal force to coarse particle extraction assembly 8.

Figure 4:
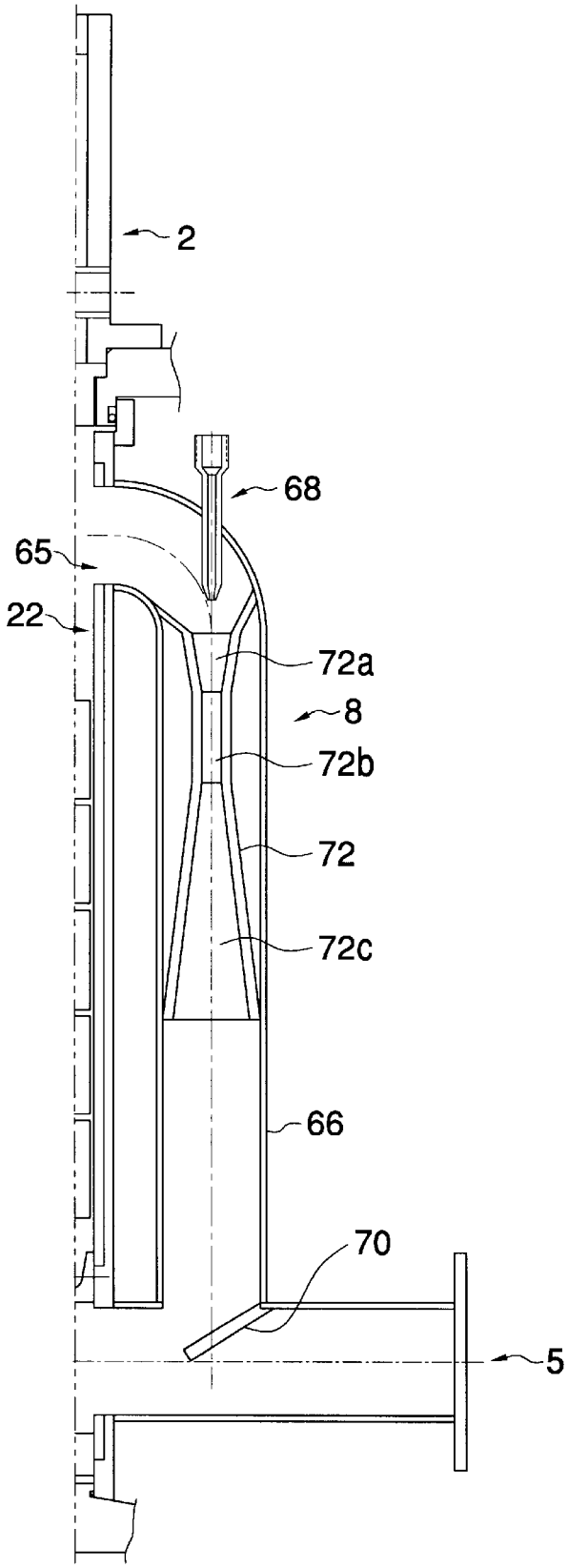
FIG. 4 is an expanded view of one coarse particle extraction assembly of the present invention.

FIG. 4 represents a detailed view of coarse particle extraction assembly 8, which can be used with any pulverizer. Preferably, the pulverizer for use with coarse particle extraction assembly 8, has a classifier that directs the coarse particle fraction towards inner liner 22, while allowing the fine particles to pass through to outlet 6.

Coarse particle extraction assembly 8 comprises extraction port 65 connecting housing 2 with pipe 66. Preferably, extraction port 65 is positioned at about the same level as classifier 10. Pipe 66 contains air nozzle 68. Nozzle 68 is positioned such that discharge of an air jet generates a vacuum at coarse particle extraction port 65. The coarse particles, presented to extraction port 65 by the classifier, are extracted by the vacuum through extraction port 65 and discharged downward toward inlet 5 whereafter they can be recirculated for further grinding. Or the coarse particles can be removed and collected by a collection device, which is not shown in the Figure.

In another embodiment, the coarse particle fraction can be propelled onto impact plate 70. Impact plate 70 may be positioned at any point in pipe 66. Preferably impact plate 70 is positioned at the returning point to inlet 5 to direct the particle air flow mixture into the inlet area. In another preferred embodiment, pipe 66 contains venturi 72 that creates controllable suction at coarse particle extraction port 65. The venturi comprises a tube with a convergent section 72*a*, a venturi throat 72*b*, and a divergent section 72*c*.

Figure 5:
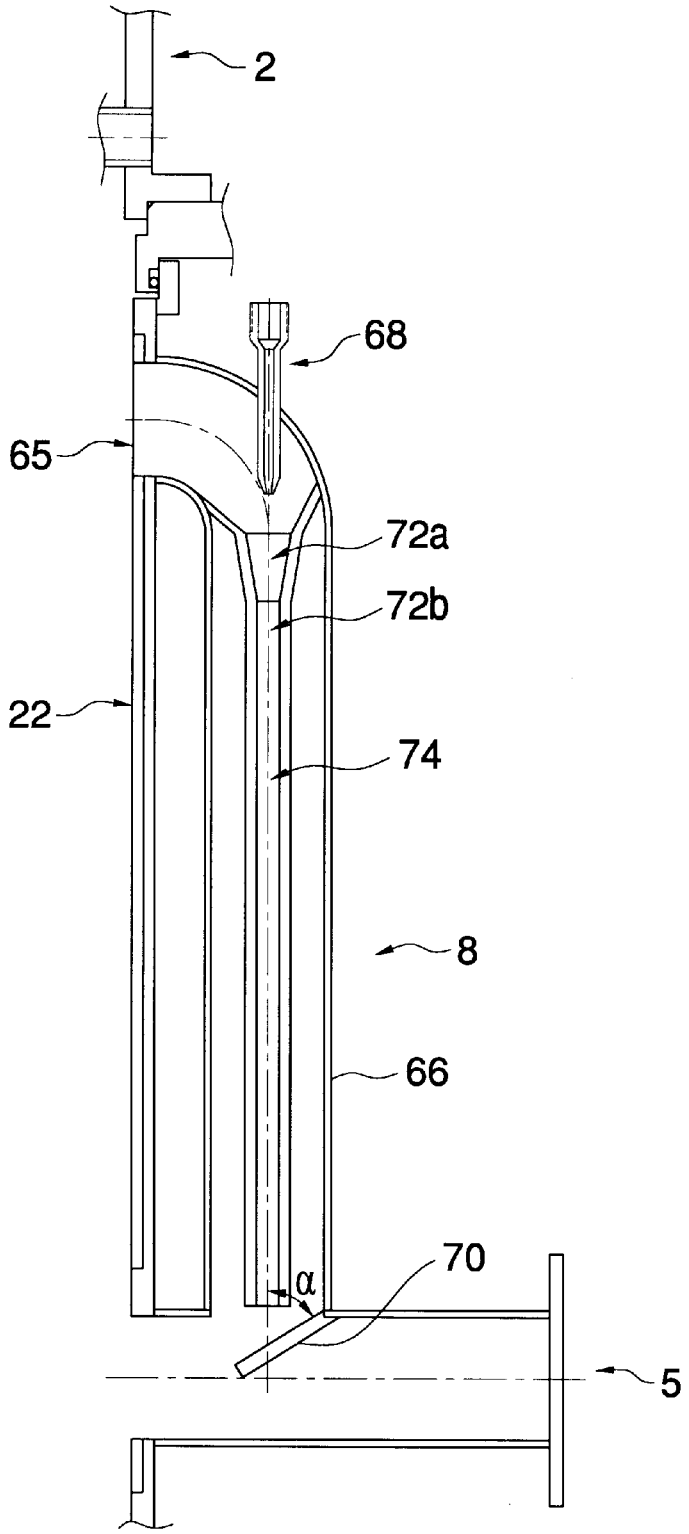
FIG. 5 is an expanded view of a coarse particle extraction assembly that is adapted for jet milling and recirculation of the impacted particle fraction.

Another embodiment of coarse particle extraction assembly 8—shown in FIG. 5—involves jet milling pulverization of the coarse particle fraction. In this embodiment, pipe 66 includes acceleration chute 74, which is a straight tube section extending from venturi throat 72*b*, wherein the convergent section 72*a* is positioned below air nozzle 68 and 74's exit is positioned over impact plate 70, preferably directly over impact plate 70 with an impact angle $\alpha$ of 450 to 90°. This modification is desirable when the coarse particles are especially hard to grind and require extra comminuting before recirculation. The coarse particle fraction enters the coarse particle extraction assembly 8 via coarse particle extraction port 65 and the coarse particles are propelled, at high velocity, into impact plate 70. The intensity of the particle impact on plate 70 can be controlled by the air jet intensity generated by air nozzle 68, the length of acceleration chute 74, and the position of impact plate 70 with respect to the acceleration chute.

Figure 6:
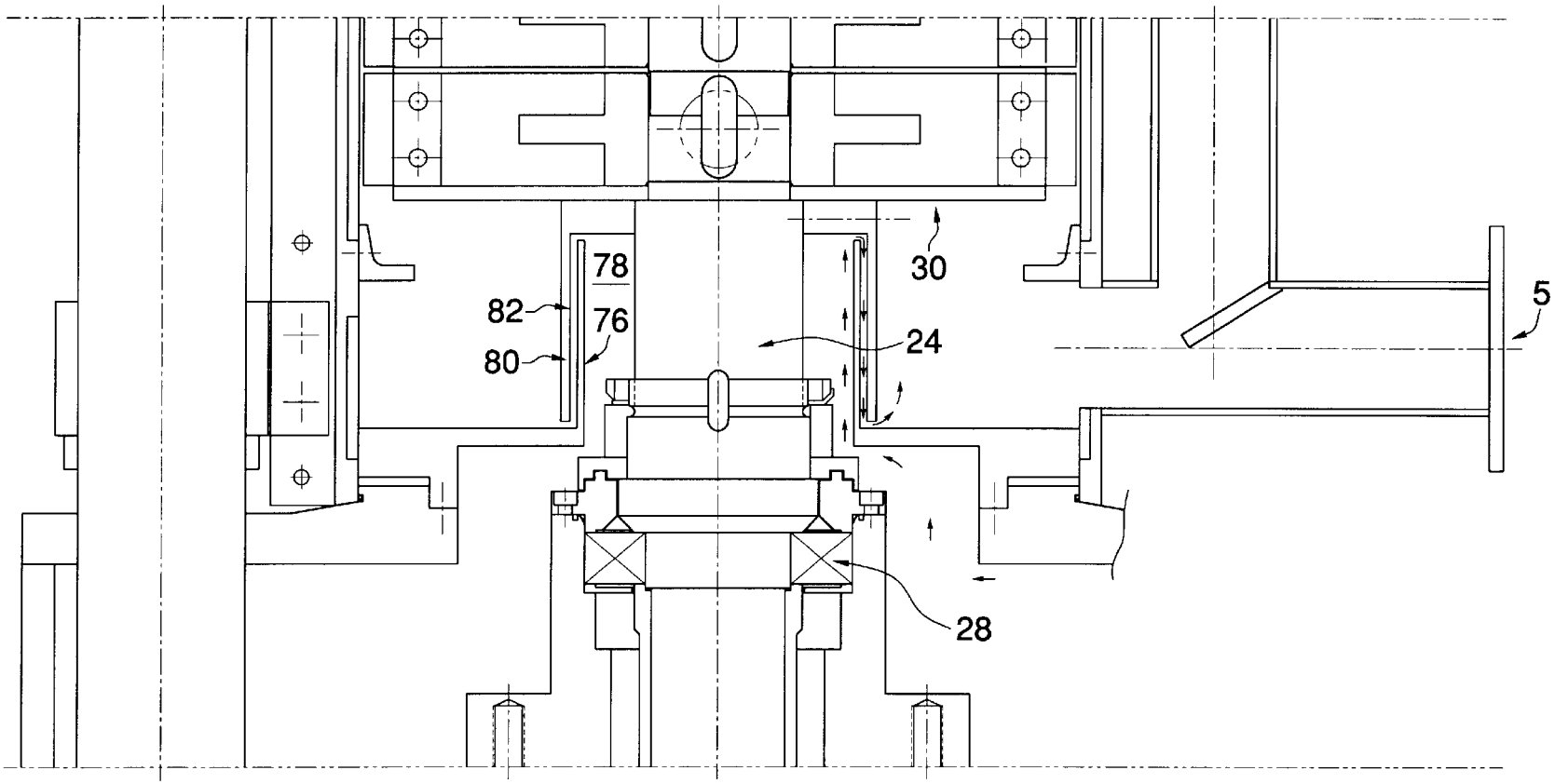
FIG. 6 is a schematic view of the free-air cooling arrangement for the drive shaft an lower bearing member.

In another embodiment, shown in FIG. 6, the present invention relates to an arrangement that allows free air cooling of both lower bearing member 28 and the area of drive shaft 24 where it meets lower bearing member 28. A stationary sleeve 76 surrounds drive shaft 24, under rotor 30, such that annular duct 78 exists therebetween. Rotatable sleeve 80 is rotatably supported by drive shaft 24 and surrounds stationary sleeve 76 such that annular void 82 is created therebetween. Annular void 82 provides a path for external air to be sucked-by the action of the suction device at outlet 6—through annular duct 78, through annular void 82, into housing 2. During operation, and especially for drying applications, the air flow cools both lower bearing member 28 and the area of drive shaft 24 where it meets lower bearing member 28 and isolates this area from the hot air environment.

In another embodiment, the pulverizer of the invention can be used in drying applications. Preferably, when the pulverizer is used for material drying, wet material feed intake 84 used (see FIG. 2). Wet material feed intake nozzle 84 is preferably located on housing 2 such that a suspension of the substrate material can be dispersed directly onto rotor 30, more preferably feed intake nozzle 84 is located on housing 2 such that the suspension can be dispersed onto the lower part of rotor 30, and even more preferably onto first rotor segment 32*a*.

Introduction of a substrate suspension to be dried, via wet material feed intake nozzle 84, is accomplished by methods well known in the art. Air, preferably hot air, may be introduced via inlet 5. In this way, the wet substrate material is sucked through particle pulverizing domain 38. Within particle pulverizing domain 38, the edges of beater plates 34 and inner liner 22 as well as the swirling air flow formed in the pockets, cooperate to disperse the substrate material in the turbulent air so as to effect drying and deagglomeration. The dried and dispersed material is collected at outlet 6. Determination of temperature and pulverizer parameters for drying a variety of materials is readily accomplished by one of ordinary skill in the art.

In a preferred embodiment for drying applications, wet material feed intake nozzle 84 comprises a slot shaped hole existing parallel to the axial direction of the housing. When a wet substrate material suspension is introduced, such a slot shaped hole provides a dispersion pattern that provides more efficient drying than achieved with conventionally shaped wet material feed intake nozzles.

Although the present invention has been described in considerable detail with reference to certain preferred embodiments, other embodiments are possible. Therefore, the spirit and scope of the appended claims should not be limited to the description of the preferred embodiments contained herein.

What is claimed is:

1. A particle pulverizing apparatus comprising;

a cylindrical housing oriented along a vertical axis, the housing provided with an inner liner, an inlet, an outlet, and a rotatable drive shaft oriented along the vertical axis and supporting a rotor having an outer diameter such that a particle pulverizing domain exists between the inner liner and the rotor and a coarse particle extraction assembly comprising an extraction port in the housing, a pipe positioned adjacent to the extraction port and including an air nozzle therein, wherein the air nozzle discharges an air jet into the pipe to generate a vacuum at the extraction port to extract coarse particles from the housing through the extraction port.

2. The pulverizing apparatus of claim 1, wherein the pipe is configured and dimensioned to provide a non-linear path for the coarse particles, and the air nozzle is positioned such that the air jet can convey and accelerate the coarse particles.

3. The pulverizing apparatus of claim 1, wherein the extraction assembly further comprises an impact plate positioned downstream of the air nozzle for directing the extracted coarse particles back into the housing.

4. The pulverizing apparatus of claim 1, wherein the pipe further comprises a venturi positioned downstream of the air nozzle to guide return of the extracted coarse particles.

5. The pulverizing apparatus of claim 3, wherein the pipe further comprises an acceleration chute positioned between the air nozzle and the impact plate for further accelerating and directing the coarse particles directly onto the impact plate for further grinding.

6. A particle pulverizing apparatus comprising:

a housing comprising an inner grinding surface, a particle inlet for receiving particles into the housing, and a rotatable drive shaft oriented along an axis and supporting a rotor defining a particle pulverizing domain between the grinding surface and the rotor, the pulverizing domain being configured for pulverizing the particles;

a coarse particle extraction assembly comprising an extraction port in the housing downstream of the pulverizing domain and configured for extracting a coarse particles portion of the particles;

a conduit communicated with the coarse particle extraction assembly for receiving and transporting the extracted coarse particles; and an air nozzle configured for discharging an air jet into the conduit to reduce the pressure at the extraction port to extract coarse particles therethrough from the housing.

7. The pulverizing apparatus of claim 6, further comprising an impact plate positioned downstream of the air nozzle for further pulverizing the coarse particles and directing the coarse particles back into the housing.

8. The pulverizing apparatus of claim 7, further comprising an acceleration chute positioned between the air nozzle and the impact plate for accelerating and directing the coarse particles to the impact plate for further pulverization.

9. The pulverizing apparatus of claim 8, wherein the acceleration chute comprises a venturi throat and a substantially uniform cross-section portion downstream of the venturi throat and extending substantially to the impact plate.

10. The pulverizing apparatus of claim 6, further comprising a venturi disposed in the conduit downstream of the air nozzle.

11. The pulverizing apparatus of claim 6, further comprising a classifier disposed downstream of the pulverizing domain and configured for separating the coarse particles portion from the particles for feeding to the extraction port.

12. A particle pulverizing apparatus comprising:

a housing having a particle inlet for receiving particles into the housing;

a primary pulverization mechanism within the housing configured for conducting a first pulverization process for pulverizing the particles;

a coarse particle extraction assembly comprising an extraction port in the housing downstream of the primary pulverization mechanism and configured for extracting a coarse particles portion of the particles;

a conduit communicated with the coarse particle extraction assembly for receiving and transporting the extracted coarse particles back to the housing upstream of the primary pulverization mechanism; and a secondary pulverization mechanism within the conduit configured for conducting a second pulverization process, different than the first pulverization process, for pulverizing the coarse particles.

13. The apparatus of claim 12, wherein:

one of the primary and secondary mechanisms comprises a rotor and grinding surface defining an pulverization domain therebetween and configured and dimensioned for pulverizing the particles in a in the pulverization domain; and the other of the primary and secondary mechanisms comprises an impact plate and an air nozzle upstream of the impact plate configured for discharging an air jet towards the impact plate to accelerate the particles towards the impact plate for pulverizing the particles.

14. The apparatus of claim 13, wherein the one of the mechanisms comprises the primary mechanism, and the other of the mechanisms comprises the secondary mechanism.

15. The pulverizing apparatus of claim 1, further comprising a rotatable classifier positioned on the drive shaft above the rotor and a stationary free air purging mechanical seal assembly supported by the housing and positioned adjacent to the classifier.

16. The pulverizing apparatus of claim 15, wherein the classifier comprises a lip having a plurality of spaced fins thereon and a baffle extending perpendicularly thereto; and the free air purging mechanical seal assembly comprises a stationary casing supported by the housing and having upper, lower, and inner walls defining an annular cavity therebetween, an aperture on the upper wall of the casing opening into a tube, which tube is connected with an air orifice in the housing to allow external air to enter the annular cavity, and an air path in the lower wall, wherein rotation of the classifier induces air flow by the action of the fins, allowing the air in the annular cavity to pass through the air path over an upper surface of the classifier and into the housing to prevent particles from passing through a seal gap.

17. The pulverizing apparatus of claim 16, wherein the lower wall includes a groove therein for receiving at least a portion of the classifier lip fins extending vertically therein.

18. The pulverizing apparatus of claim 16, wherein the air path in the lower wall comprises a plurality of equally spaced holes for controlling distribution of air onto the upper surface of the classifier.

19. The pulverizing apparatus of claim 16, further comprising an annular opening extending around the inner wall adjacent to the baffle.

20. The pulverizing apparatus of claim 16, wherein the lower portion of the inner wall of the casing comprises a notch to receive at least a portion of the baffle.

21. The pulverizing apparatus of claim 17, further comprising a free air cooling arrangement comprising a stationary sleeve surrounding the drive shaft under the rotor, the stationary sleeve forming a annular duct around the drive shaft for providing a first path for external air to flow through the annular duct into the housing for cooling the drive shaft.

22. The pulverizing apparatus of claim 21, further comprising a rotatable sleeve rotatably supported by the drive shaft surrounding the stationary sleeve for creating an annular void therebetween that provides a second path for the external air to flow into the housing when the apparatus is in operation.

23. The pulverizing apparatus of claim 22, further comprising a wet material feed intake nozzle comprising a slot shaped hole located on the housing near the rotor for dispersing a suspension of wet particulate material onto the rotor.

* * * * *